United States Patent [19]

Hetzel

[11] Patent Number: 4,911,665

[45] Date of Patent: Mar. 27, 1990

[54] GEARCASE EXHAUST RELIEF FOR A MARINE PROPULSION SYSTEM

[75] Inventor: Robert H. Hetzel, Oshkosh, Wis.

[73] Assignee: Brunswick Corporation, Skokie, Ill.

[21] Appl. No.: 228,319

[22] Filed: Aug. 4, 1988

[51] Int. Cl.[4] ..... B63H 1/26

[52] U.S. Cl. ..... 440/89; 60/319

[58] Field of Search ..... 440/88, 89; 60/272, 60/281, 310, 319, 317, 320; 181/220, 221, 235, 259, 260, 212, 213

[56] References Cited

U.S. PATENT DOCUMENTS

| | | | |
|---|---|---|---|
| 3,745,964 | 7/1973 | Henrich | 440/89 |
| 3,911,852 | 10/1975 | Miller | 440/89 |
| 4,036,162 | 7/1977 | Maier | 440/89 |
| 4,304,558 | 12/1981 | Holdermann | 440/89 |
| 4,331,429 | 5/1982 | Koepsel | 440/89 |
| 4,507,892 | 3/1985 | Hall | 440/89 |
| 4,600,395 | 7/1986 | Pichl | 440/89 |
| 4,773,215 | 9/1988 | Winberg | 440/89 |

*Primary Examiner*—Sherman D. Basinger
*Assistant Examiner*—Clifford T. Bartz
*Attorney, Agent, or Firm*—Andrus, Sceales, Starke & Sawall

[57] ABSTRACT

An exhaust relief outlet is provided in the lower end of a marine propulsion system lower unit for providing exhaust relief to an internal exhaust passage formed in the lower unit. The exhaust relief outlet is provided in the rear end of the lower unit and is disposed adjacent an area of restricted exhaust flow formed by converging walls of the internal exhaust passage. The exhaust relief outlet is located so as to discharge exhaust into the upper half of the path of the propeller as it rotates about a propeller shaft. The exhaust relief outlet both relieves exhaust pressure within the exhaust passage and provides controlled ventilation to the propeller for allowing increased acceleration and planning ability for a marine propulsion system.

3 Claims, 1 Drawing Sheet

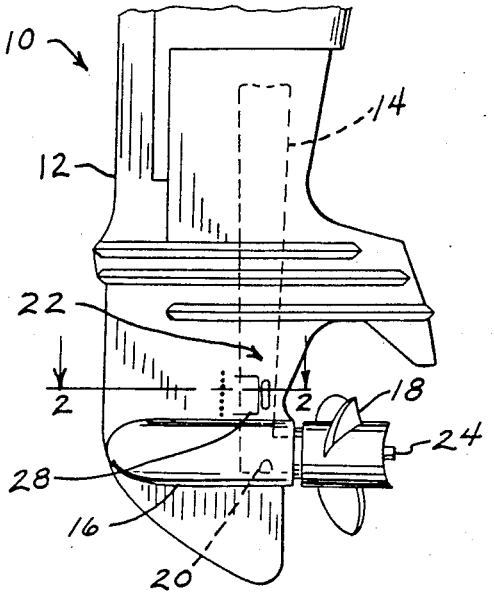
FIG. 1
FIG. 2
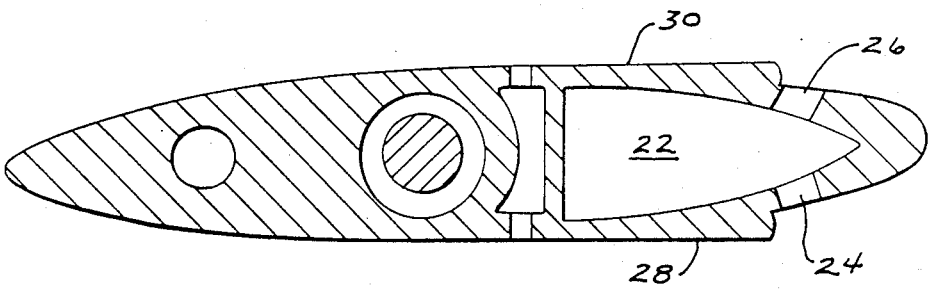
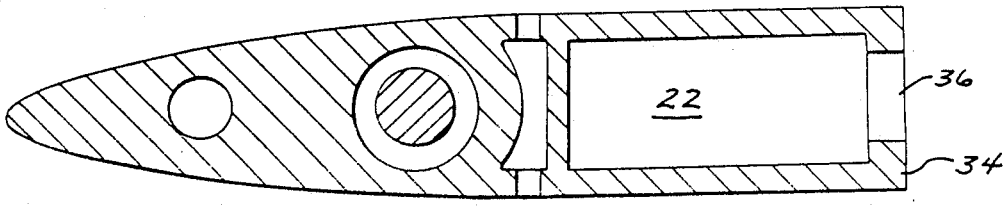
FIG. 3

GEARCASE EXHAUST RELIEF FOR A MARINE PROPULSION SYSTEM

BACKGROUND AND SUMMARY

This invention relates to a marine propulsion system, and more particularly to an exhaust discharge system for a marine propulsion system.

In a marine propulsion system, it is known to route exhaust gas through an internal exhaust discharge passage formed in the housing of the marine propulsion system. In an outboard motor, for example, the discharge system typically includes an exhaust passage provided in the lower unit of the motor which houses the drive shaft and the gearcase. A propeller is generally mounted to a propeller shaft disposed in the lower end of the lower unit, and it is desirable to provide an exhaust passage which discharges exhaust through the hub of the propeller. Such discharge of the exhaust provides quiet operation of the motor and enhances performance. A similar manner of discharging exhaust is used in connection with a stern drive system.

It has been found to be desirable to minimize the surface area of the submerged portion of the marine drive lower unit transverse to the direction of water flow therepast, in order to reduce drag caused by such submerged portion. The desirability of reducing the transverse surface area of the submerged portion of the lower unit housing results in a configuration of the lower portion of the gearcase which provides a restricted area for exhaust flow through the exhaust discharge passage formed therein. This restricted area of exhaust flow is normally located just prior to entrance of the exhaust into the propeller shaft housing. At certain operating conditions, such area of restricted exhaust flow can cause a bottleneck in the exhaust discharge system which is unable to accommodate the exhaust output produced by the engine. In this circumstance, the performance of the engine suffers.

It has also been found that, to increase boat performance, it is desirable to vent exhaust gas into the path of the propeller as it rotates. Such discharge of exhaust gas into the propeller path ventilates the propeller, thus allowing the engine to move quickly into the power band for relatively rapid acceleration and planing ability.

The present invention is designed to relieve the bottleneck in the exhaust discharge system and also to ventilate the propeller. In accordance with the invention, in an exhaust system including an internal exhaust passage leading to an exhaust passage in the hub of the propeller, a pair of exhaust outlet passages are disposed upstream of the propeller hub exhaust passage. The exhaust outlet passages are in communication with the internal exhaust passage, and are arranged so that one passage is provided on each side of the lower unit. The pair of exhaust outlet passages are preferably located so as to be in the upper half of the path of the propeller, to provide controlled ventilation of the propeller. The sides of the gearcase may be provided with a flared or ramped area forwardly of the exhaust outlet passages for deflecting water over the exhaust outlet passages as the lower unit moves forwardly through the water.

In another embodiment of the invention, a substantially flat rear face is provided on the lower unit. An exhaust outlet passage is formed in the rear face upstream of the propeller hub exhaust passage for providing exhaust relief. The substantially flat rear face of the lower unit preferably has a transverse dimension at least approximately that of the greatest transverse dimension of the lower unit, and the exhaust outlet passage is located so that exhaust is discharged into the upper hal of the path of the propeller. This construction also provides controlled ventilation of the propeller, and also discharges exhaust into the low pressure area created by the flat rear face of the lower unit as it moves forwardly in the water, thereby increasing performance.

BRIEF DESCRIPTION OF THE DRAWINGS

The drawings illustrate the best mode presently contemplated of carrying out the invention.

In the drawings:

FIG. 1 is a partial side elevation view of an outboard marine motor and depending gearcase incorporating an exhaust relief outlet according to the invention;

FIG. 2 is a sectional view taken generally along line 2—2 of FIG. 1; and FIG. 3 is a view similar to FIG. 2, showing an alternate embodiment of the invention incorporating a flat rear face on the lower portion of the gearcase.

DETAILED DESCRIPTION OF THE PREFERRED EMBODIMENT

With reference to FIG. 1, an outboard motor 10 includes a power head (not shown) and a depending drive shaft housing 12. Exhaust is routed from an internal combustion engine from the power head through an internal exhaust passage 14 formed in drive shaft housing 12. Exhaust passage 14 generally extends from the upper end of drive shaft housing 12 to the lower end of drive shaft housing 12. A "torpedo" 16 is formed in the lower end of drive shaft housing 12 and houses a propeller shaft to which a propeller 18 is mounted. Exhaust passage 14 is generally in communication at its lower end with an internal exhaust passage 20 formed in torpedo 16. Exhaust gas is routed through passage 14 and torpedo exhaust passage 20 for discharge through the hub of propeller 18.

In the lower end of drive shaft housing 12, the walls of exhaust passage 14 generally converge due to the desirability of minimizing the surface area of the lower end of drive shaft housing 12. The converging walls of exhaust passage 14 define an area of restricted exhaust flow, designated generally at 22. This area 22 of restricted exhaust flow can, under some operating conditions, operate as a bottleneck for exhaust passing through exhaust passage 14, which adversely affects the performance of the engine.

To relieve the exhaust pressure within exhaust passage 14 at restricted area 22, a pair of exhaust relief vents 24, 26 (FIG. 2) are provided in the side walls of drive shaft housing 12 adjacent restricted area 22. Exhaust relief vents 24, 26 are in communication with restricted area 22 of exhaust passage 14, and are disposed upstream of propeller hub exhaust passage 20 and are disposed toward the rear of drive shaft housing 12.

Exhaust relief vents 24, 26 are formed in the lower end of drive shaft housing 12 so as to be in the upper half of the path of propeller 18 as it rotates about the propeller shaft. In this manner, exhaust discharged through exhaust relief vents 24, 26 bleeds into the path of propeller 18 as it rotates. This provides controlled ventilation of propeller 18, thus allowing the engine to come into the power band for faster acceleration and planing ability. If the engine is raised on the transom, after the boat is on plane exhaust relief vents 24, 26 may be located above the water line, thus allowing exhaust to be vented directly to the atmosphere without affecting propeller performance. In this condition, the propeller path is half in and half out of the water.

A pair of ramped areas 28, 30 are formed on each side of the lower end of drive shaft housing 12 adjacent openings 24, 26. Ramped areas 28, 30 act to deflect water over exhaust relief vents 24, 26 as drive shaft housing 12 moves forwardly through the water. With this construction, the low pressure area formed rearwardly of ramped areas 28, 30 as the drive shaft housing 12 moves through the water is filled with exhaust discharged through vents 24, 26 to negate any adverse effect on engine performance which may be caused by such low pressure areas. Under most operating conditions, exhaust relief vents 24, 26 will be submerged below water, to thereby provide quiet operation of outboard motor 10.

In the alternate embodiment shown in FIG. 3, a substantially flat face 34 is formed on the rear of the lower portion of drive shaft housing 12. An exhaust outlet passage 36 is substantially centrally located on rear face 34, and is in communication with restricted area 22 of internal exhaust passage 14 for discharging exhaust therefrom. Exhaust outlet passage 36 is positioned on drive shaft housing 12 so as to be in the upper half of the path of propeller 18 defined by rotation of propeller 18.

Rear face 34 has a width substantially that of the widest portion of the lower end of drive shaft housing 12. In this manner, a low pressure area formed rearwardly of rear face 34 when drive shaft housing 12 moves forwardly through the water is filled with pressurized exhaust passing from exhaust outlet passage 36 so as to negate any decrease in performance which may be caused by such a low pressure area.

The invention thus provides both an exhaust relief for a restricted area of exhaust flow formed in the exhaust passage provided in the lower unit, and also allows controlled ventilation of the propeller during its rotation. These features of the invention increase boat performance while providing little or no increase in noise generated by outboard motor 10 during operation, due to the submerged location of the exhaust outlet under most operating conditions.

Various alternatives and modifications are contemplated as being within the scope of the following claims particularly pointing out and distinctly claiming the invention.

I claim:

1. In a marine propulsion system including a lower unit with a propeller connected thereto, and in which engine exhaust is routed through an internal exhaust passage formed in the lower unit prior to discharge through an exhaust passage in the hub of the propeller, the improvement comprising:

a pair of exhaust outlet passages disposed upstream of said propeller hub exhaust passage and toward the rear of said lower unit, said passages being arranged one on either side of said lower unit, said passages being in communication with said internal exhaust passage formed in said lower unit for discharging exhaust therefrom and being located so as to discharge exhaust into the upper half of the path of said propeller defined by rotation of said propeller; and water deflection means provided on the sides of said lower unit forwardly of said passages for deflecting water over said passages as said lower unit moves forwardly through the water, said water deflection means comprising a ramped area provided on each side of said lower unit forwardly of said passages, said ramped areas terminating at a point forwardly of and closely adjacent said passages.

2. A marine propulsion system comprising:

a lower unit having a propeller connected thereto, wherein engine exhaust is routed through an internal exhaust passage formed in the lower unit prior to discharge through an exhaust passage in the hub of the propeller, wherein said lower unit is provided with a substantially flat rear face having a transverse dimension of said lower unit; and an exhaust outlet passage formed in said lower unit upstream of said propeller hub exhaust passage in said substantially flat rear face of said lower unit, said exhaust outlet passage being in communication with said internal exhaust passage formed in said lower unit for discharging exhaust therefrom, said exhaust passage being located so as to discharge exhaust into the upper half of the path of said propeller defined by rotation of said propeller.

3. The marine propulsion system according to claim 2, wherein said exhaust outlet passage is substantially centrally located on said flat rear face of said lower unit.

* * * * *

UNITED STATES PATENT AND TRADEMARK OFFICE

CERTIFICATE OF CORRECTION

PATENT NO. : 4,911,665

DATED : March 27, 1990

INVENTOR(S) : HETZEL, ROBERT H.

It is certified that error appears in the above-identified patent and that said Letters Patent is hereby corrected as shown below:

Claim 2, Col. 4, Line 35, After "dimension" insert --- at least approximately that of the greatest transverse dimension ---.

Signed and Sealed this

Seventh Day of May, 1991

*Attest:*

HARRY F. MANBECK, JR.

*Attesting Officer*

*Commissioner of Patents and Trademarks*